United States Patent [19]

Boyce

[11] 4,399,996

[45] Aug. 23, 1983

[54] PRACTICE BAT

[76] Inventor: Gary C. Boyce, 2253 Shawnee Trail, Okemos, Mich. 48864

[21] Appl. No.: 195,329

[22] Filed: Oct. 9, 1980

Related U.S. Application Data

[63] Continuation of Ser. No. 949,618, Oct. 10, 1978, abandoned.

[51] Int. Cl.[3] ..... A63B 69/40

[52] U.S. Cl. ..... 273/26 B

[58] Field of Search ..... 273/26 B, 67 B, 67 R, 273/67 DA, 67 DB, 68, 72 R, 73 R, 75, 77 R, 81 R, 80 B, 80.2, 80.3, 193 B, 183 D, 186 A; 64/15 R, 15 C; 403/229

[56] References Cited

U.S. PATENT DOCUMENTS

| | | | |
|---|---|---|---|
| 537,927 | 4/1895 | Kennedy | 273/72 R |
| 1,616,377 | 2/1927 | Knight | 273/193 B |
| 2,158,211 | 5/1939 | Aitken | 273/193 B |
| 2,159,579 | 5/1939 | Whitney | 273/193 B |
| 2,497,273 | 2/1950 | Reineking | 273/193 B |
| 2,949,752 | 8/1960 | Menoni | 64/15 R |
| 3,170,690 | 2/1965 | Garanson | 273/193 B |
| 3,246,894 | 4/1966 | Salisbury | 273/26 B |
| 3,679,205 | 7/1972 | Finkle | 273/193 B |
| 3,698,712 | 10/1972 | Pero | 273/26 B |

FOREIGN PATENT DOCUMENTS

| | | | |
|---|---|---|---|
| 1819 | of 1915 | United Kingdom | 273/80.3 |

*Primary Examiner*—Richard C. Pinkham
*Assistant Examiner*—T. Brown
*Attorney, Agent, or Firm*—Miller, Morriss & Pappas

[57] ABSTRACT

A baseball practice bat for training baseball players in the art of batting. The practice bat has a head portion and a separate handle portion. These are articulated axially. The head portion is positioned to be gripped by one hand and the lower handle grip portion positioned to accommodate the other hand of a batter on respective sides of the articulating joint. The articulating joint is a spring means secured on one side to the head portion and on the other side to the handle portion so that at rest the handle portion is an axial extension of the head portion. A bumper is provided between the head portion and the handle portion in prevention of "pinching". When the practice bat of the present invention is swung, the lower hand on the grip portion tends to "post" and the upper hand on the head portion moves through in controlled fashion by the spring.

6 Claims, 7 Drawing Figures

PRACTICE BAT

This is a continuation of application Ser. No. 949,618, filed Oct. 10, 1978 (abandoned).

BACKGROUND OF THE INVENTION

Teaching or training batters in baseball is an extremely difficult task and the better batters have developed a "snap" to the stroke at impact resulting from a "posting" of the lower grip on the bat and a sudden surge or thrust with the upper hand. While this is appreciated in strobe light and photographic analysis of batting, it requires a tactile experience to show, exaggerate or synthesize the movement of the bat in the hands of the practicing batter. The present device seeks to develop the precision of movement in a gradual and tactile manner which forces the batter to gently appreciate and develop the acceleration of the bat needed to establish a power impulse effective on the ball.

In the prior art weighted bats have been used as exemplified in the recent U.S. Pat. No. 3,955,816 to Leonard R. Bratt directed to a warm-up bat in which the weight and location of the weight could be varied. While this has a good feature in warm-up, it does not train the batter to accelerate the bat at a precise time during the swing. A similar type of device was earlier seen in golf club trainers as described by Garland P. Atkinson in U.S. Pat. No. 3,428,325. In the U.S. Pat. No. 3,246,894, William F. Salisbury proposed a bat for practice in which selected portions of the striking surface were reduced and a striking zone was established for visibility during swing and at impact. A shock reduction feature was included but the two hands of the batter did not receive separate but coordinated stressing as will be found present in the devices of the present invention. Another category of prior art structures is exemplified in the instructional batting device of Minden Vaughan Blake in the U.S. Pat. No. 2,772,887 in which a mass is caused to shift position under the dynamics and centrifugal effect of a swing. None of these devices are seen to have the unusual ability to train mediocre batters to accelerate their stroke by proper coordinated leverage and usage of both hands to establish a "snap" action at that portion of the swing where impact is desired and to teach the top hand to drive the head of the bat ahead of the lower hand and in front of the body of the batter.

The principal object of the present invention is to provide a new coaching tool in baseball which adapts itself to the individual batting styles of players but teaches them to achieve a proper acceleration at the impact portion of the swing and adjusted to their own stance and posture. It is a training tool that employs a natural expedient in coordinating the function of the two hands and with the shoulders, wrists and arms acting to provide a dynamic and dramatic upgrading of stroke.

A further object is to provide a training tool which frees the coach from intensive and exhaustive theoretical discussion and allows the trainee, through practice, to intuitively reach a full appreciation of what is needed to enhance the quality of batting by use of the present invention.

The device under test has provided a measurable improvement in batting training and has been lauded by mediocre players for developing timing and coordination to the end of increase to proper bat velocity and acceleration.

Another object is to provide a practice bat which, when swung, immediately explains in a tactile experience the need and means for coordinated hand, wrist and arm and shoulder action in batting at imaginary targets or balls as well as at actual pitching. Since the contribution of the present practice bat is to enhance the velocity of the bat at the impact portion of the swing, it is of substantial assistance to all players. The present invention is equally instructive in all batting type games and while intended primarily as a baseball batting trainer, it is useful in softball, hardball, cricket and the like where an articulated joint intermediate two aligned hand grip surfaces is possible.

In general the present invention is a practice bat for use in baseball and other batting sports and the bat has three principal parts, a head portion, a grip portion and an articulating intermediate joint normally securing the head portion, the grip portion and the articulating joint, in axial alignment. The joint may be flexed by differential thrust applied at the grip portion and at the head portion. The grip portion accommodates the full grip of the lower hand of a batter. In a left handed hitter the lower hand is the right hand. In a right handed hitter the lower hand is the left hand. Then the upper hand of the batter is on the other side of the joint and gripping the head portion at its lowermost end. As will be seen, the upper hand must lead the lower hand to provide good quality batting and maximum bat velocity at impact of bat to ball.

When thus gripped, the bat provides a unique tactile sensation when swung by a batter toward a real or imaginary target. The lower hand tends to "post" and the upper hand overruns the lower hand imparting a leverage and acceleration to the impact portion of the bat that can be immediately comprehended by a batter in coordination of hands in the swing. By practicing with the bat, users improve their hand coordination, wrist and forearm strength, and improve their batting by producing better bat acceleration at impact and thereby hitting longer balls. A bumper is provided on both sides of the articulated joint so that as the head portion overruns the grip portion the hands and/or fingers will not be pinched. The experiences with the training bat are then transferred effectively to actual bats on the playing fields.

In the manufacture of the practice bat of the present invention the articulated joint is a resilient element such as a coil spring with the ends of the spring being secured to the handle and to the head portion in cylindrical recesses which extend axially into the grip and head portions, respectively. The spring element is fastened in place transversely through the grip and head portions and the fasteners or pins extend radially through the axial center line of grip and head and through the spring element. A potting resin imbeds the spring and fasteners in situ and secures them to the bats against shock and withdrawal. The potting resin is preferably a dimensionally stable epoxy resin mixed with suitable hardeners and with or without fillers, as required. The epoxies provide a hard, tough matrix when cured in situ. This anchors the ends of the spring in place in the axial openings in the adjacent ends of the head and grip portions. The adhesive capabilities of the epoxy resins is also helpful in prevention of the spring from working free of the connection in practice. Bumpers in the form of annular rings are secured at the adjacent ends of the head and grip elements and may be bound or adhered to the material forming the bat. A silicone rubber bumper is easily formed and may be stretched into place or are molded and are then attached to the bat.

The spring element allows flexure as between the head portion and the grip portion and hence bridges the axial gap between the head and grip. The lower end of the head provides a grip surface for the upper hand. The grip portion provides a grip surface for the lowermost hand. The bat may be made from wood, metal or plastic material or may be laminated in the manner of forming baseball or other bats. The spring may be of any resilient material having selected strength and energy storing characteristics.

In usage the practice bat is gripped with both hands as a real bat and is swung on real or imaginary targets and the flexure at the joint teaches the general "posting" of the lower hand and "snap-through" of the upper hand with wrist and forearm strain. This stressing teaches the proper coordination of hands and body to strike the ball and to follow-through with proper acceleration. The practice bat adapts to existing movement, postural and stance characteristics of the individual batter. Accordingly, the practice bat does not destroy style but enhances velocity. A few swings and an appreciation of proper form is imparted to the hitter. With additional practice with given style and strength, the practice bat improves the performance of the batter. As will be appreciated, the invention is applicable to all two handed sports involving a bat or club such as used in baseball, cricket, golf and the like.

IN THE DRAWINGS

In the drawings

Figure 7:
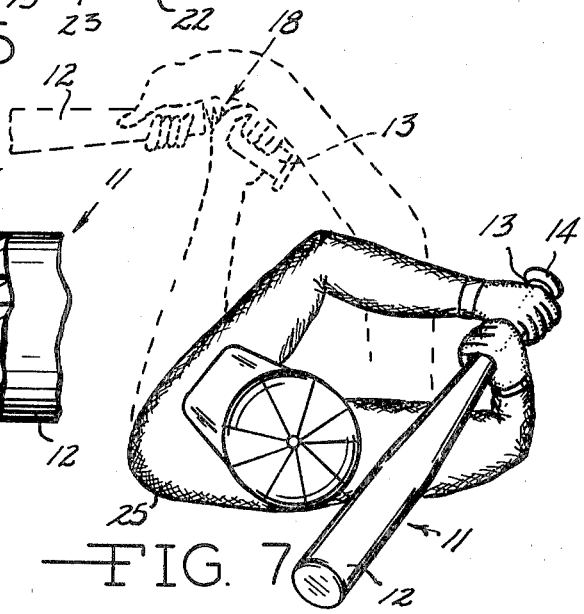

FIG. 7 is a somewhat schematic top plan view of a batter gripping the bat of the present invention and shown in full line at the start of the swing and in broken line during the follow-through of the swing and indicating the flexure at the spring joint between the hands whereby the upper hand leads and snaps over with the head portion beyond the posting lower hand. This motion imparts desired batting coordination and acceleration at the zone of impact.

SPECIFIC DESCRIPTION

Figure 1:
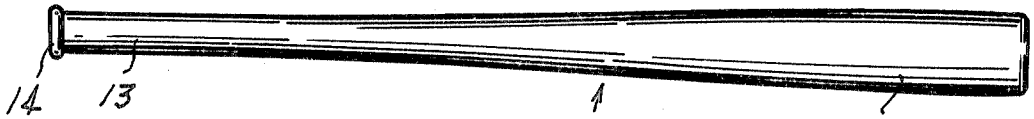
FIG. 1 is a side elevation view of a playing bat such as a baseball bat.

Referring to the drawing and most specifically first to the FIG. 1 thereof, a typical baseball bat 11 is shown which is elongate, generally cylindrical and includes a head portion 12 and a grip portion 13. While a baseball bat is described, other bat-like elements such as cricket bats and golf clubs with two handed gripping also comprehended as the subjects of the present invention. The head portion 12 includes the impact end of the bat 11 and tapers down to the grip portion 13. The bat 11 is a two handed structure so that when the bat 11 is gripped one hand is lowest on the grip portion 13 adjacent or closest to the flared butt portion 14. The uppermost hand in baseball is above or toward the head portion 12 of the bat 11. In swinging the bat 11 a right handed batter grips the bat 11 with the left hand on the grip portion 13 adjacent the flared butt 14. The right hand also grips the bat 11 but above the left hand and toward the head portion 12 thereof. The bat 11, being relatively rigid and made of wood, metal or plastic, has little appreciable flexure and as the bat 11 is swung, both hands of the batter remain on the grip portion 13 and in axial alignment with the bat 11. The arms, shoulders and wrists coordinate with the hands in traveling the bat 11 on an arc in front of the batter but most importantly in good batters it is noted that the lower hand "posts" and the upper hand then pivots on the posting hand or wrist to accelerate the head of the bat 11 in the already existing crescent or arc of the swing. This posting motion is essential to the desired acceleration of the bat 11 at the impact area. The leverage of the bat 11 is thus exploited. This unusual acceleration is observed in batting as a factor separating excellence from mediocrity. To some it has been felt that training toward achieving the needed acceleration is impossible because it is intuitive and a fine balance between eye, stance, posture and muscular coordination.

Figure 2:
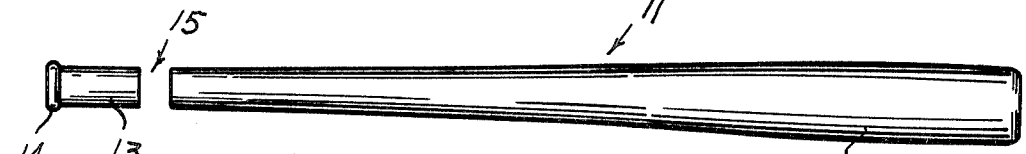
FIG. 2 is a bat shown in side elevation as in the FIG. 1 but transversely cut to form a handle or grip portion and a club portion.
Figure 3:
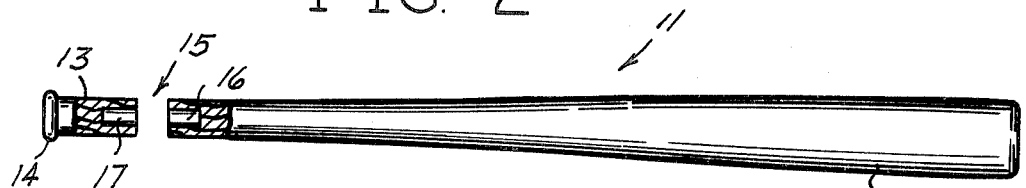
FIG. 3 is a bat shown in side elevation as in the FIG. 2 but with the handling or grip portion partially cut away to show the axial openings or recesses provided in the adjacent ends.
Figure 4:
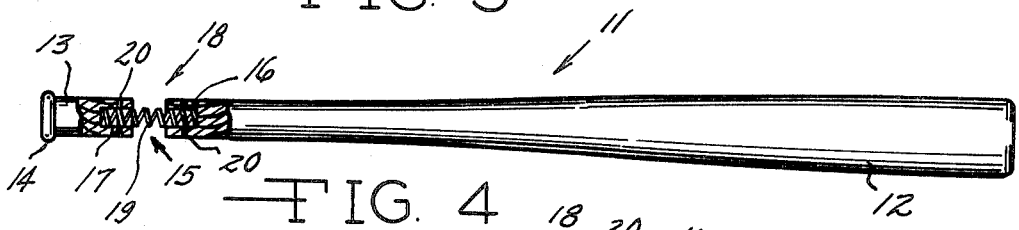
FIG. 4 is a side elevation view of a bat as seen in FIG. 3 and partially cut away and having a spring axially inserted in the axial openings provided in the head and the grip portions and secured in place by transverse fasteners.

In FIG. 2 the first step toward achieving a training tool for batters will be appreciated. The bat 11 is severed transversely making a separation 15 between the grip portion 13 and the head portion 12. In FIG. 3 axial openings 16 and 17 are provided in the ends of the head portion 12 and grip portion 13 of the bat 11 on facing adjacent sides of the gap 15. As will be appreciated, the grip portion 13 is of such a size as to accommodate one hand of a batter but not both hands. In FIG. 4 an articulating joint 18 is provided bridging the gap or separation 15 between the grip portion 13 and the head portion 12. As will be seen, the articulating joint 18 provides connected flexure or resilience between the grip portion 13 and the head portion 12 while at rest securing the bat 11 and its component parts in axial alignment. The articulating joint 18 is secured tightly to the grip 13 and head portion 12 in the openings 17 and 16, respectively. A stiff coil spring 19 is the preferred form of the joint 18 and fasteners such as pins 20 transversely pass through the grip portion 13 and the head portion 12 and through the spring 19 and the openings 17 and 16, respectively. The stiffness of the spring 19 can be selected according to the strength and needs of individual trainees. This construction is better appreciated in FIG. 5 where a potting resin 21 such as an epoxy resin or plastic fills the openings 17 and 16 and fully imbeds and encapsulates the ends of the spring 19 and the pins 20 which pass through the openings 17 and 16. The potting resin 21 is cured in situ while the grip portion 13 and head 12 are maintained in axial alignment. In the FIG. 5 a minor deviation from drawing conventions is noted in presentation of the potting resin 21 to best illustrate the spring 19. The pins 20 pass through the axis of the bat 11 in at least two directions, as shown. The potting resin 21 is a good adhesive with metal, wood and most plastics and achieves an excellent anchor of the articulating joint 18 secure against torsional and other stresses at the grip portion 13 and at the head portion 12. An annular bumper 22 with molded annular keeper rings 23 as, for example, in silicone rubber, is provided on both sides of the gap or separation 15 in resilient prevention of pinching the hands or fingers of the batter in practice with the bat 11 since one hand grips the bat 11 on one side of the joint 18 and the other hand grips the bat 11 on the other side of the joint 18. As will be seen, and depending upon the rigidity of the spring 19, the grip portion 13 and head portion 12 are thrown out of axial alignment when the bat 11 is swung.

Figure 5:
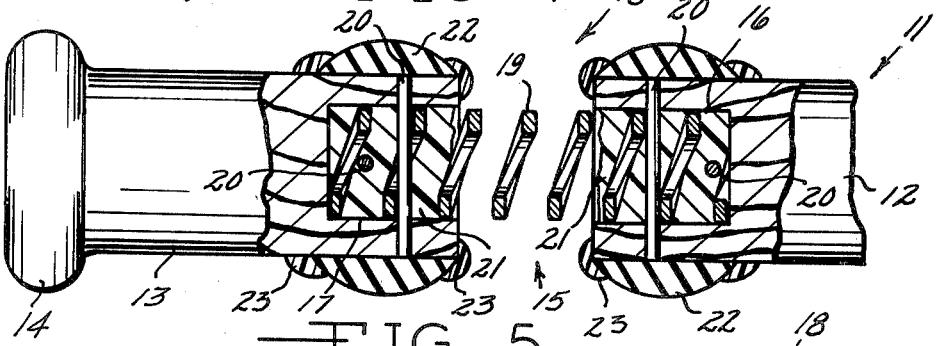
FIG. 5 is a partially cut away enlarged side elevation view of the bat seen in FIG. 4 and the spring potted and embedded in position by a plastic filler or matrix.
Figure 6:
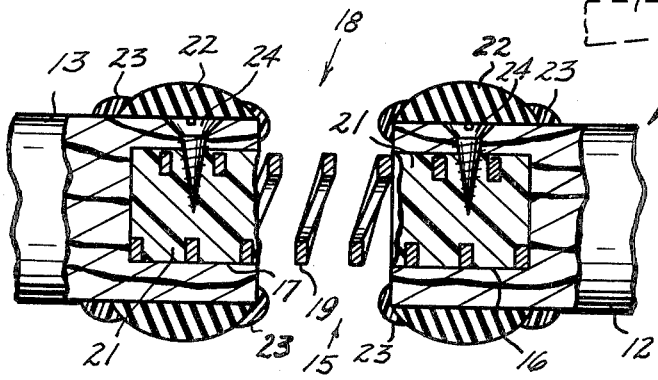
FIG. 6 is a partially cut away enlarged side elevation view of the practice bat of the present invention with fasteners such as screws providing transverse anchorage of bat and spring into the plastic matrix.

FIG. 6 shows a modified version of the construction of the joint shown in the FIG. 5 where plural fasteners 24, such as screws, are employed instead of pins 20. The advantage is that the screws 24 do not easily work free and if they do so they are easily retightened as necessary.

By reference to FIG. 7, the advantageous use of the bat 11 for training will be readily appreciated since in full line the batter 25 (shown as a right hander) grips the bat 11 in preparation for a swing. Assuming proper stance or posture, the swing describes an arc involving shoulders, forearms, wrists and hands with all forces translated at the grip. The lower hand, however, in a proper swing commences to post or lag as the bat 11 comes in front of the batter 25 and the upper hand accelerates the head portion 12 of the bat 11 in reference to the grip portion 13. The articulating joint 18 and spring 19 absorbs the excess energy and a tactile sensation is appreciated by the batter 25 strengthening the wrist muscles and reflexes used in the posting transition at the grip and training the batter 25 to properly accelerate the head of the bat 11 in baseball.

The bat 11 is prepared for manufacture by cutting a conventional bat 11 across its principal axis to form a separate grip portion 13 and a head portion 12. Then axial openings are provided in the ends of the portions 12 and 13 at the cut. A spring 19 is then inserted in the openings so as to bridge the gap 15 between the portions 12 and 13 to establish an articulated joint 18 normally holding the bat 11 and its portions 12 and 13 in axial alignment. Fastener elements are inserted to secure the spring 19 against torsional or axial displacement by passing the fasteners through the grip portion 13 and head portion 12 and through the respective openings 17 and 16 and passing through the axial center line of the bat 11. The fastening is made firm by a potting 21 resin such as epoxy resin with suitable hardener poured into the openings 16 and 17 and hardened and cured in situ imbedding the fasteners and ends of the spring 19 while adhering to the walls of the openings 16 and 17. The bumpers 22 and keepers 23 are applied adjacent the gap or separation 15 and are secured in place in prevention of "pinching".

The strength and weight of the springs 19 is a matter of choice and selection. The material in the spring 19, as illustrated, was steel. Other spring materials may be used provided adequate rigidity is available and rugged serviceability. The bats 11 may be made from metal, wood or plastic and may be hollow, selectively weighted or of variant selected length. Similarly the bats 11 may have various heads for sports other than baseball as seen in cricket bats and golf clubs, for example.

In usage the practice bat of the present invention enables the batter to understand that the top hand drives the head of the bat in front of the body and forces both hands to work together in imparting an increase in velocity to the bat at an appropriate point to result in a more powerful swing. The power thus developed in the dynamics of moving the bat at the grip results in a transfer of energy to the ball on contact with the bat.

Having thus described my invention, others skilled in the art will readily appreciate improvements, modifications and changes and such improvements, modifications and changes are intended to be included within the spirit of the present invention limited only by the scope of the hereinafter appended claims.

I claim:

1. A practice bat for establishing a swing coordination as between hands in a two-handed baseball swing movement comprising:

a head portion having a substantially uniform diameter and elongate shape at one end of said bat;

a handle portion having a substantially uniform diameter at the other end of said bat and extending a predetermined distance along said bat;

a tapered portion of said bat extending from said head to said handle portion; and a resilient means separating said handle into two separate grip portions and normally biasing said grip portions to coaxial alignment with said head and said tapered portions.

2. A practice bat in accord with the claim 1 wherein said resilient means comprises a resilient element axially extending from said head portion and from said grip portion and securely connected to each.

3. In the practice bat of claim 2 in which said resilient element is an energy storing spring means.

4. In the practice bat of claim 3 in which said spring means is a coil spring potted in situ in said head and said grip portions and including a plurality of transverse pins through said grip portion and said head securing said spring against torsional removal therefrom.

5. A practice bat for establishing a swing coordination as between hands in a two-handed swing movement comprising:

an elongate head having an axial opening in one end;

a grip element having a generally cylindrical configuration and having an axial opening in one end thereof;

a spring axially into the openings in said head and said grip;

a plurality of pins through said head and said grip and passing transversely through said spring in said axial openings;

a potted plastic matrix filling said openings and imbedding said spring and said pins;

said spring forming a resilient gap between said head portion and said grip portion and separating said grip portion into a pair of grips, an upper and lower grip; and bumpers around said grip and head portions adjacent said gap.

6. A method for manufacture of a training bat having an universal articulated flexible joint between adjacent hand grip areas, one on the grip side and one on the head side of the bat including the steps of:

cutting a conventional bat across its principal axis to form a separate lower grip portion and an upper head portion;

forming an axial opening in the grip portion and in the head portion at the ends adjacent the cut;

inserting a spring element into the openings formed in the upper head portion and the lower grip portion with said spring bridging a gap between said grip portion and said head portion;

transversely applying fastener elements which run through the axis of said head and grip portions and through the spring and axial openings while retaining said spring, said grip and said head in axial alignment substantially filling said openings and imbedding said spring and said fasteners with a potting compound of resin and hardener and curing said resin in situ; and applying an annular bumper over said grip and said head at the ends of said grip and head from which said spring extends.

* * * * *